US009956758B2

(12) United States Patent
Zhou et al.

(10) Patent No.: US 9,956,758 B2
(45) Date of Patent: May 1, 2018

(54) ZERO ALCOHOL OFFSET PRINTING SYSTEM

(71) Applicant: YUNNAN JOY PRINTING TECHNOLOGY CO., LTD., Kunming (CN)

(72) Inventors: Daoming Zhou, Kunming (CN); Ho Ming Au Yeung, Kunming (CN); Jin Zhou, Kunming (CN); Jing Zhang, Kunming (CN); Fei Jiang, Kunming (CN)

(73) Assignee: YUNNAN JOY PRINTING TECHNOLOGY, CO., LTD., Kunming (CN)

( * ) Notice: Subject to any disclaimer, the term of this patent is extended or adjusted under 35 U.S.C. 154(b) by 0 days. days.

(21) Appl. No.: 15/054,392

(22) Filed: Feb. 26, 2016

(65) Prior Publication Data

US 2017/0106645 A1 Apr. 20, 2017

(30) Foreign Application Priority Data

Oct. 14, 2015 (CN) ..... 2015 1 0662688

(51) Int. Cl.

| | |
|---|---|
| ***B41M 1/06*** | (2006.01) |
| ***B41F 7/26*** | (2006.01) |
| ***B41F 7/02*** | (2006.01) |
| ***B41N 7/04*** | (2006.01) |

(52) U.S. Cl.

CPC ..... *B41F 7/26* (2013.01); *B41F 7/02* (2013.01); *B41N 7/04* (2013.01); *B41M 1/06* (2013.01); *B41N 2207/02* (2013.01); *B41N 2207/10* (2013.01)

(58) Field of Classification Search

CPC ..... B41F 7/26

See application file for complete search history.

(56) References Cited

U.S. PATENT DOCUMENTS

2010/0147174 A1* 6/2010 Takei ..... B41F 7/32 101/492

FOREIGN PATENT DOCUMENTS

CN 101817252 A * 9/2010 ..... B41F 31/26

* cited by examiner

*Primary Examiner* — Joshua D Zimmerman

(74) *Attorney, Agent, or Firm* — Morgan, Lewis & Bockius LLP; Jeffry S. Mann

(57) ABSTRACT

This invention relates to a zero alcohol offset printing system, comprises the following parts: Plate cylinder (3), its outer cylindrical surface is covered by printing plate (4); Ink exertion system (1), which comprises ink source (8) and several inking rollers, to exert ink to the printing plate; Dampening liquid exertion system (2), which comprises dampening liquid source (7) and several dampening rollers, to exert dampening liquid to the printing plate; wherein the dampening rollers include a distributor roller (6); wherein the structure of the distributor roller (6) is as follows: it comprises a metal cylinder surrounded by a ceramic layer, and the ceramic layer has texture on its outer surface; wherein the content of alcohol or ether in the dampening liquid is zero.

9 Claims, 2 Drawing Sheets

ZERO ALCOHOL OFFSET PRINTING SYSTEM

CROSS-REFERENCE TO RELATED APPLICATIONS

This application claims benefit of CN 201510662688.4 filed on Oct. 14, 2015, which is incorporated herein by reference in its entireity.

FIELD OF THE INVENTION

This invention belongs to the technical field of offset printing machine.

BACKGROUND OF THE INVENTION

Traditional offset printing use the theory that dampening liquid cannot mix with ink, nature of the patterned area on the printing plate is hydrophobic and has affinity to ink, so as to print ink onto this area. The non-patterned area on the printing plate is coated with a thin dampening liquid film, which is hydrophilic and is repellent to ink. Thus, the non-patterned area not be covered by the dampening liquid will not be printed by ink, and there is no dampening liquid film on printed area. In order to let the dampening liquid film smoothly formed, the surface tension of water need to be reduced. Therefore in the nowadays offset printing technique, ethanol, Isopropyl Alcohol (IPA), ether or other substituting agent has to be added to the dampening liquid to reduce the water surface tension.

However, there are many disadvantages of ethanol, IPA, ether or other substituting agent: 1. IPA is a harmful material with high volatility, no matter it is emitted to the air or to the nature, it will have pollution to environment, especially in a relatively close printing workshop, the volatilized IPA vapor will be seriously harmful to human's health; 2. Ethanol & IPA are flammable, their flash point is so low that they can easily burn or explode, so they are extremely unsafe; 3. Increase printing operational cost; 4. Causing many printing problems, since ethanol, IPA, ether or other substituting agent can dissolve and dilute ink, the ink at the boundary between the ink surface and water surface will be easily erode and incur printing problems such as poor ink drying, ink nebulization, ink's pile up, ink easily pull out, ink fading, etc.

Over the years, people have tried to improve the formulation of ink or dampening liquid so as to solve the above-mentioned problems. For example, they have tried to change the formulation of ink to enhance its resistance to the dampening liquid erosion, or to change the formulation of the dampening liquid to reduce its erosion to ink, wherein the later is getting more interest of the people. With a growing concern and attention of humans on the environment, health, safety, people's research turn into the use of ethanol or isopropyl alcohol substituting agent to reduce or even eliminate the percentage of ethanol or isopropyl alcohol in the dampening liquid. In domestic and international, now people are adding substituting agents of ethanol (these substituting agents all belong to alcohols or ethers substances, such as propylene glycol, ethylene glycol, diethylene glycol, propylene glycol methyl ether, etc.) into the dampening liquid, so as to replace ethanol or isopropyl alcohol (IPA). But these substituting agents can not completely replace ethanol or isopropyl alcohol (IPA). Thus, some so-called "non-alcohol" dampening liquids containing these substituting agents cannot be totally free of alcohol, actually they generally have an alcohol content of at least 5 wt %.

Furthermore, these substituting agents are expensive, apart from the increase of printing cost, they still cannot solve the problems such as ink erosion, environment pollution, health harm, etc., For example, the substituting agent to alcohol and ether has more erosion to ink and incur to more problems than ethanol during the printing operation, such as poor ink drying, ink fading, ink nebulization, ink's pile up, ink easily pull out, and poor color control, etc.

Currently in the offset printing technology field, people are willing to invent or innovate an absolute zero alcohol offset printing system (i.e., the dampening liquid in this offset printing system is totally free of alcohol), so as to solve above long lasting problems.

The present invention uses a different approach to solve the above technical problems, and firstly proposes a zero alcohol offset printing system in the domestic and international level and successfully implements it.

DETAILED DESCRIPTION OF INVENTION

The present invention is achieved by the following technical solution: In the first aspect of the invention, it discloses a zero alcohol offset printing system, which comprises the following parts: Plate cylinder (3), its outer cylindrical surface is covered by printing plate (4); Ink exertion system (1), which comprises ink source (8) and several inking rollers, to exert ink to the mentioned printing plate; Dampening liquid exertion system (2), which comprises dampening liquid source (7) and several dampening rollers, to exert dampening liquid to the mentioned printing plate; wherein the dampening rollers include a dampening form roller (5) and a distributor roller (6); Wherein the structure of the mentioned distributor roller (6) is as follows: it comprises a metal cylinder surrounded by a ceramic layer, and the ceramic layer has texture on its outer surface; The content of alcohol or ether in the dampening liquid is zero.

For easy understanding to this invention, explanations of technical terms are as follows: "Printing Plate" means a metal plate of around 0.3 mm thickness; it is a major carrier for printing image.

"Printing Cylinder" is a cylinder used to carry the printing plate, the printing plate usually install to the outer cylindrical surface of the printing cylinder and rotate with the printing cylinder.

"Ink Exertion System" includes an inking source and several inking rollers. During rotation, ink will be spread out from one roller to another and finally be transformed and offset printed to the patterned area of the printing plate.

"Dampening Liquid Exertion System" includes a dampening liquid source and several dampening rollers. During rotation, the dampening liquid will be spread out from one roller to another and finally be transformed and offset printed to the non-patterned area of the printing plate.

"Dampening liquid" means, in offset printing, a kind of liquid with a functionality of separation to patterned imaging area and the non-patterned area, its major content is water and it comprises a certain volume of additives such as printing plate protecting agent, wetting agent, ethanol or IPA, buffering agent, antibacterial agent, etc.

"Fountain solution" is a solution containing additives other than the ethanol and IPA, which is added to the damp water, it mainly comprises electrolyte such as phosphate or nitrate, Arabic gum, carboxymethyl cellulose, etc. Wherein the electrolyte is used to supplement the inorganic salt layer and stabilize pH, and the Arabic gum or carboxymethyl cellulose is used to strengthen the sturdy level of the blank space on the printing plate by its absorbability to surface of solid.

"Emulsification" means, in offset printing, the erosion of ink by the dampening liquid. Emulsification will cause ink indistinct and weaken the attaching force, it will decline the printing quality so it needs to be prevented.

"Floating Dirt" means the supply capacity of dampening liquid is too insufficient to separate the patterned imaging area and non-patterned area from each other and causes the ink is printed in the non-patterned area. Floating Dirt will decline the printing quality so it needs to be prevented.

"Dampening form Roller" is one of the dampening rollers which has direct in touch with the printing plate. The evenly spreading level of the dampening liquid film on the surface of this roller will determine the evenly spreading level of the dampening liquid film on the printing plate.

"Distributor roller" refers to a metal roller which can transversally or longitudinally move in the dampening liquid exertion system of the offset printing equipment (transversally moving distance 5-50 mm). This distributor roller is in contact with the dampening form roller, the main role is to store a certain amount of dampening liquid and spread dampening liquid evenly on the dampening form roller.

"Zero alcohol printing" refers to the dampening liquid in the offset printing equipment is completely free of alcohol and ether, in other words, the alcohol and ether content in the dampening liquid is zero.

In a preferred embodiment of the present invention, the texture is linear texture or honeycomb shaped texture, but not be limited to the linear texture or honeycomb shaped texture, other types of texture can also be used. The linear texture refers to the linear texture in form of a plurality of parallel fold lines or curves.

In a preferred embodiment of the present invention, the thickness of the ceramic layer is 0.05-1.5 mm, the LPI (Line per Inch) of linear texture is 60-1500, and the depth of a linear texture is 0.05-1 mm. The ceramic layer may be prepared to form a coating layer on the outer surface of the metal roller by any suitable means, such as by ionization spraying mode, porcelain-calcining mode and so on.

After preparation of the ceramic layer to the metal roller, the ceramic layer can also be finely processed to improve its surface smoothness, and then be engraved by the laser electronic engraving technology to form the texture.

In a preferred embodiment of the present invention, there is no sandblasting layer between the metal cylinder and the ceramic layer of the distributor roller, i.e., the ceramic layer is in direct contact with the metal cylinder.

In the present invention, the alcohols or ethers materials include: ethanol, isopropyl alcohol, ethylene glycol, propylene glycol, propylene glycol, propylene glycol methyl ether, ethylene glycol, diethylene glycol, and the like.

The second aspect of the invention relates to a zero alcohol offset printing method, which comprises the following steps: a. Mounting the printing plate to out cylindrical surface of the plate cylinder; b. Exerting dampening liquid by the dampening liquid exertion system to the mentioned printing plate to form a patterned dampening liquid film, the mentioned dampening liquid exertion system comprises dampening liquid source and several dampening rollers, wherein the several dampening rollers include a distributor roller, which comprises a metal cylinder surrounded by a ceramic layer, and the ceramic layer has texture on its outer surface; wherein the content of alcohol or ether in the dampening liquid is zero; c. Exerting ink by an ink exertion system to the non-patterned area which is not covered by the patterned dampening liquid film, the ink exertion system comprises ink source and several inking rollers; d. Transforming the pattern on the printing plate to a blanket, and in turn transforming the pattern from the blanket to the printing paper or printing object, to complete printing process.

After doing a series experiments, the inventor proved that: by using the distributor roller having above structural features, its capability to spread the dampening liquid into film is greatly enhanced. It can evenly spread the dampening liquid into film in the absence of the ethanol or isopropyl alcohol, with the printing results even better than the presence of alcohol or isopropyl alcohol in the dampening liquid. Over the years, the offset printing technical field has been relying on the addition of chemical agents (such as adding ethanol, isopropyl alcohol or ether) to promote the dampening liquid to be evenly spread into a film, while the present invention uses a totally physical method to solve the above problems.

Compared with the prior art, the beneficial effects of the present invention are as follows: 1. Safety and environmental protection: the dampening liquid does contain ethanol, isopropyl alcohol (IPA), or other alcohols or ethers substances. The environment in the printing workshop has been greatly improved and is beneficial to the health of employees and eliminate the fire hazards; The natural environment has been improved because there is no pollution caused by the emissions of isopropyl alcohol (IPA) or its substituting chemical agents; 2. Cost savings: saving the cost of printing companies to buy ethanol and isopropyl alcohol (IPA), and also reduce or eliminates VOC emissions tax; 3. Improve printing effect: because the dampening liquid contains no agent that can dilute or dissolve the ink, at the interface between the ink layer and the dampening liquid layer, the ink and the dampening liquid will not erode each other, so a effect of "dampening liquid-oil immiscibility" is really realized. Therefore, the printing products have relatively stable hue and very good drying effect, and dot hue reproduction is good; in particular, for those print products which have high quality requirements, such as bar code, printing solid, gold and silver ink printing, the present invention have excellent performance; 4. Room-temperature printing: because the dampening liquid contains no alcohol or ether, the printing can be operated at room temperature, rather than cooling down the dampening liquid the dampening to less than 10° C.

The reference numbers in the figures have the following meanings: (1) Ink exertion system; (2) Dampening liquid exertion system; (3) plate cylinder; (4) printing plate; (5) dampening form roller; (6) distributor roller; (7) dampening liquid source; (8) ink source.

EXAMPLES

The present invention is further illustrated in conjunction with examples. The examples should not be construed as limiting the scope of the present invention.

Comparative Example 1

Figure 1:
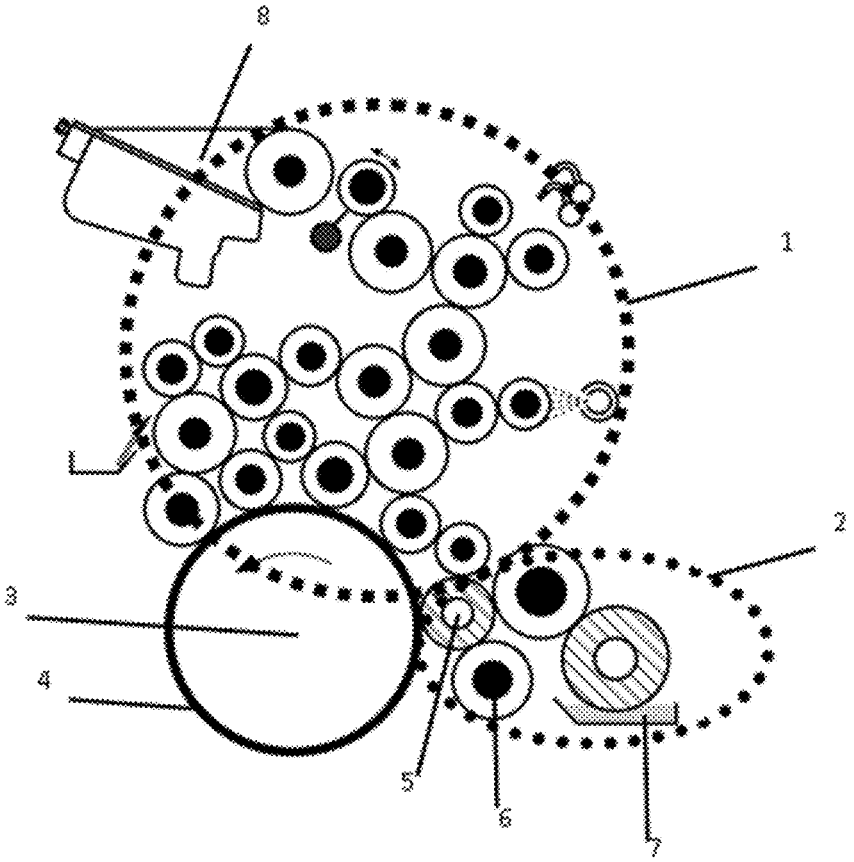
FIG. 1 is a schematic diagram of an offset printing system.
Figure 2:
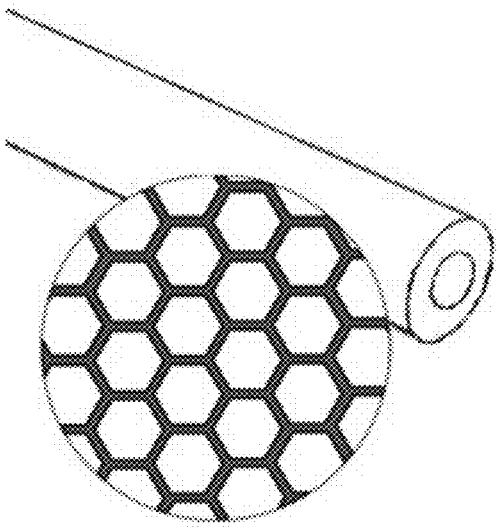
FIG. 2 is a schematic view of a honeycomb shaped texture on the surface of the distributor roller.

An offset printing system shown in FIG. 1 is used. The system is the German Heidelberg CD102 model offset printing machine, all using their original ink exertion system and dampening liquid exertion system, including the distributor roller (6), the surface structure and shape characteristics of the distributor roller are as follows: metal roller blank, which comprises a metal cylinder and a sandblasting layer coating on its outer surface, said sandblasting layer having irregular texture on its outer surface. This system use commercially available dampening liquid which has an ethanol or isopropyl alcohol (IPA) content of 10%-25%, if the content is too low then printing cannot be operated. The adding amount of fountain solution is about 3.5%.

Comparative Example 2

An offset printing system shown in FIG. 1 is used. The system is the German Heidelberg CD102 model offset printing machine, all using their original ink exertion system and dampening liquid exertion system, including the distributor roller (6), the surface structure and shape characteristics of the distributor roller are as follows: metal roller blank, which comprises a metal cylinder and a sandblasting layer coating on its outer surface, said sandblasting layer having irregular texture on its outer surface. The adding amount of fountain solution is about 3.5%, and the dampening liquid has an ethanol or isopropyl alcohol (IPA) content of less than 5%, i.e., the dampening liquid is the so-called "alcohol free" dampening liquid, It virtually uses alcohols or ethers as the ethanol or isopropyl substituting agent, so reduce the surface tension of water during printing, but at the same time, the erosion to the surface of the ink is also very serious, resulting in more printing problems, the cost is also increased a lot.

Example 1

In this example the German Heidelberg CD102 model offset printing machine is also used, but the distributor roller (6) is as described in the present invention. The surface structure and shape characteristics of the distributor roller are as follows: metal roller blank, which comprises a metal cylinder and a ceramic layer covering on its outer surface, said ceramic layer having regular texture on its outer surface. After preparation of the ceramic layer to the metal roller, the ceramic layer can also be finely processed to improve its surface smoothness, and then be engraved by the laser electronic engraving technology to form the texture. There is no sandblasting layer between the metal cylinder and the ceramic layer of the distributor roller, i.e., the ceramic layer is direct contact with the metal cylinder. The ink layer is not eroded during printing, the printing performance is excellent, the printing problems can be better solved.

The dampening liquid used in the present invention has an alcohol or ether content of 0%. The fountain solution is commercially available and contains no alcohol or ether, amount of about 3.5%. The adding amount of fountain solution is about 3.5%.

The distributor roller (6) in the present invention is prepared by covering a ceramic layer with thickness 0.13 mm on the outer surface of a metal roller 5. The surface of the ceramic layer is engraved by the laser electronic engraving technology to form the honeycomb shaped texture, wherein the density of the honeycomb shaped texture is 1200 LPI, and the depth of the texture is 0.043 mm.

Printing Effect Experiment

Some well-recognized challenging printing tasks in the offset printing industry are used to evaluate the printing performance of the Comparative Example 1 and Example 1. The challenging printing task is the full solid printing on the hard cigarette wrapping paper whose surface is covered with aluminum foil. We printed 210,000 sheets. This product will be printed with six colors, and among the six colors, three colors are printed in full solid printing, two color are spot white ink printing, one color is dot gradation printing.

The results are as follows:

| comparative items | Alcohol or isopropyl alcohol (IPA) content (wt %) | Content of dampening liquid additive solution (wt %) | production (ten thousand/ sheets) | Production quality (scrap) | Hue rejection rate (%) | Dryness | Dot repro-duction | Process downtime | Ink emulsification dirty float | White ink printing plain degree |
|---|---|---|---|---|---|---|---|---|---|---|
| Comparative Example 1 | 12% | 3.5% | 4 | 5.2% | 3.5% | not good | normal | 68 | Serious | good |
| Comparative Example 2 | 2.3% | 4.2% | 3.1 | 8.9% | 6.8 | Not good | Not good | 7.9 | Serious | normal |
| Example 1 | 0 | 3.5% | 4.1 | 3.8 | 1.2 | Very good | better | 66 | no | Very good |

As can be seen from the experimental results of Comparative Example 1, Comparative Example 2 and Example 1, the offset printing system of the present invention can not only save cost, improve production efficiency and reduce scrap and process downtime, but also greatly improve the ink dryness, ink emulsification, floating dirty, white ink printing plain.

As can be seen from the above results, the zero alcohol offset printing system of the present invention, use a dampening liquid exertion system which has specific surface features, even in the absence of ethanol or isopropyl alcohol in the dampening liquid, can also achieved the same or even superior printing results as compared with conventional offset printing system which use a dampening liquid containing ethanol or isopropyl alcohol.

The foregoing is only preferred embodiments of the present invention, and is not intended to limit the present invention, any modifications, equivalent replacement and improvement made within the spirit and principles of the present invention, should be included in the protection scope of the present invention.

What is claimed is:

1. A zero alcohol offset printing system, comprising the following parts:

plate cylinder (3), its outer cylindrical surface covered by printing plate (4);

ink depositing system (1), comprising ink source (8) and several inking rollers, to deposit ink to the printing plate;

dampening liquid exertion system (2), comprising dampening liquid source (7) and several dampening rollers, to deposit dampening liquid to the mentioned printing plate; wherein the dampening rollers include a distributor roller (6); wherein:

the structure of the distributor roller (6) comprises a metal cylinder surrounded by a ceramic layer on its outer surface wherein the ceramic layer is in direct contact with the metal cylinder, and the ceramic layer has texture on its outer surface; and, the content of alcohol or ether in the dampening liquid is zero.

2. The zero alcohol offset printing system according to claim 1, wherein the texture is a linear texture or a honeycomb shaped texture.

3. The zero alcohol offset printing system according to claim 2, wherein a thickness of the ceramic layer is 0.1-1.5 mm, a lines per inch (LPI) of the linear texture is 60-1500, and a depth of the linear pattern is 0.05-1 mm.

4. The zero alcohol offset printing system according to claim 2, wherein the thickness of the ceramic layer is 0.1-1.5 mm, the LPI of honeycomb shaped texture is 60-1500, and a depth of the honeycomb shaped texture is 0.05-1 mm.

5. The zero alcohol offset printing system according to claim 1, wherein there is no sandblasting layer between the metal cylinder and the ceramic layer of the distributor roller.

6. The zero alcohol offset printing system according to claim 1, wherein the alcohol is selected from ethanol, isopropyl alcohol, ethylene glycol, propylene glycol and glycerol.

7. The zero alcohol offset printing system according to claim 1, wherein the ether is propylene glycol methyl ether.

8. A zero alcohol offset printing method, comprising the following steps:

a. Mounting a printing plate onto the outer cylindrical surface of a plate cylinder;

b. Depositing dampening liquid by a dampening liquid depositing system to the printing plate to form a patterned dampening liquid film, the dampening liquid depositing system comprises a dampening liquid source and several dampening rollers, wherein the several dampening rollers include a distributor roller, which comprises a metal cylinder surrounded by a ceramic layer on its outer surface, thereby omitting the sandblasting layer, and the ceramic layer has texture on its outer surface; wherein the content of alcohol or ether in the dampening liquid is zero;

c. Depositing ink by an ink depositing system to a non-patterned area on the printing plate which is not covered by the patterned dampening liquid film, the ink depositing system comprises an ink source and several inking rollers;

d. Transforming the pattern on the printing plate to a blanket, and in turn transforming the pattern from the blanket to the printing paper or printing object, to complete printing process.

9. The zero alcohol offset printing method according to claim 8, wherein the thickness of the ceramic layer is 0.05-1.5 mm, and the texture is linear texture or honeycomb shaped texture, and the LPI of texture is 60-1500, and the depth of the texture is 0.05 to 1 mm.

* * * * *